US008795036B2

(12) United States Patent
Hoglund

(10) Patent No.: US 8,795,036 B2
(45) Date of Patent: Aug. 5, 2014

(54) METHOD FOR MANUFACTURING A FLEXIBLE ABRASIVE DISC, AND A FLEXIBLE ABRASIVE DISC

(75) Inventor: Goran Hoglund, Nykarleby (FI)
(73) Assignee: Oy Kwh Mirka AB (FI)

( * ) Notice: Subject to any disclaimer, the term of this patent is extended or adjusted under 35 U.S.C. 154(b) by 198 days.
(21) Appl. No.: 13/301,045
(22) Filed: Nov. 21, 2011
(65) Prior Publication Data

US 2012/0122382 A1 May 17, 2012

Related U.S. Application Data

(63) Continuation of application No. 11/774,915, filed on Jul. 9, 2007, now abandoned.
(30) Foreign Application Priority Data

Jul. 10, 2006 (FI) ..... 20065490

(51) Int. Cl.

| | |
|---|---|
| ***B24B 1/00*** | (2006.01) |
| ***B24B 21/00*** | (2006.01) |
| ***B24D 11/00*** | (2006.01) |
| ***B24D 18/00*** | (2006.01) |

(52) U.S. Cl.
CPC ..... *B24D 11/001* (2013.01); *B24D 18/0009* (2013.01)
USPC ..... 451/526; 451/49; 451/507; 451/303; 51/295

(58) Field of Classification Search
None
See application file for complete search history.

(56) References Cited

U.S. PATENT DOCUMENTS

| | | | |
|---|---|---|---|
| 2,292,261 | A | 8/1942 | Albertson |
| 2,612,736 | A | 10/1952 | Lewis |
| 2,970,929 | A | 2/1961 | Hansen et al. |
| 3,377,264 | A | 4/1968 | Duke et al. |
| RE29,592 | E | 3/1978 | Vinard |
| 4,380,471 | A | 4/1983 | Lee et al. |
| 4,539,017 | A | 9/1985 | Augustin |
| 4,930,266 | A | 6/1990 | Calhoun et al. |
| 5,175,965 | A | 1/1993 | Sanborn |
| 5,273,558 | A | 12/1993 | Nelson et al. |
| 5,304,223 | A | 4/1994 | Pieper et al. |
| 5,435,816 | A | 7/1995 | Spurgeon et al. |

(Continued)

FOREIGN PATENT DOCUMENTS

| | | |
|---|---|---|
| CN | 1141016 A | 1/1997 |
| CN | 2395848 | 11/1999 |
| CN | 1767926 | 11/2002 |
| EP | 0147633 | 7/1985 |
| EP | 0396150 | 11/1990 |
| FR | 2860744 | 4/2005 |
| GB | 1005448 | 9/1965 |
| JP | 384544 | 3/1960 |
| JP | 4229887 | 5/1991 |
| JP | 07186030 | 4/1995 |
| JP | 11239979 | 2/1998 |
| JP | 2002510848 | 4/1999 |
| JP | 11512874 | 9/1999 |
| JP | 2002542021 | 4/2000 |
| JP | 2002178264 | 6/2002 |
| JP | 2004527388 | 9/2004 |
| WO | WO92/13680 | 8/1992 |
| WO | WO 9213680 | 8/1992 |
| WO | WO 0102772 | 1/2001 |
| WO | WO 0104227 | 1/2001 |
| WO | 2006054725 | 5/2006 |

OTHER PUBLICATIONS

Office Action dated May 28, 2013 for corresponding Japanese Application No. 2007-179186.
Japanese App No. 2007-179186 Office Action translation.
Chinese App No. 200710136215.6 Office Action translation (Nov. 17, 2010).
Chinese App No. 200710136215.6 Office Action translation (Jan. 22, 2010).

*Primary Examiner* — Melvin C Mayes
*Assistant Examiner* — Sheng H Davis
(74) *Attorney, Agent, or Firm* — Altera Law Group, LLC

(57) ABSTRACT

The present invention relates to a method for manufacturing a flexible abrasive disc, and to such an abrasive disc. The abrasive disc comprises a backing with an upper side and a lower side. The upper side has an abrasive agent coating for forming a surface layer. In order to form a surface layer as specifically patterned as possible, the backing of each abrasive disc is coated separately. In this manufacturing method, the abrasive agent coating on the upper side of the backing is embossed with an embossing mold specially structured and to be pressed against the backing.

16 Claims, 5 Drawing Sheets

(56) References Cited

U.S. PATENT DOCUMENTS

| | | | |
|---|---|---|---|
| 5,482,496 | A | 1/1996 | Lanzer |
| 5,672,097 | A | 9/1997 | Hoopman |
| 5,681,217 | A | 10/1997 | Hoopman et al. |
| 5,685,935 | A | 11/1997 | Heyer et al. |
| 5,785,784 | A | 7/1998 | Chesley et al. |
| 5,928,394 | A | 7/1999 | Stoetzel |
| 6,129,540 | A | 10/2000 | Hoopman et al. |
| 6,386,079 | B2 | 5/2002 | Hoopman |
| 6,645,263 | B2 | 11/2003 | Keipert et al. |
| 7,044,989 | B2 | 5/2006 | Welygan et al. |
| 7,396,501 | B2 | 7/2008 | Pope et al. |
| 7,544,113 | B1 | 6/2009 | Benner |
| 2003/0119437 | A1 | 6/2003 | Rich et al. |
| 2004/0031205 | A1 | 2/2004 | Ohishi |
| 2004/0097175 | A1 | 5/2004 | Moore |
| 2005/0032469 | A1 | 2/2005 | Duescher |
| 2005/0182606 | A1 | 8/2005 | Chida et al. |
| 2006/0010780 | A1 | 1/2006 | Hall et al. |
| 2007/0017161 | A1 | 1/2007 | Peterman, Jr. et al. |
| 2008/0118718 | A1 | 5/2008 | Koike et al. |

METHOD FOR MANUFACTURING A FLEXIBLE ABRASIVE DISC, AND A FLEXIBLE ABRASIVE DISC

This application is a Continuation of patent application Ser. No. 11/774,915, filed Jul. 9, 2007, which is now abandoned.

TECHNICAL BACKGROUND

The present invention relates to a method for manufacturing a flexible abrasive disc The invention also relates to a flexible abrasive disc manufactured with this method

PRIOR ART

It is known from the prior art to manufacture flexible abrasive means by coating an extensive material strip with composite formations precisely shaped, usually with a pyramid shape. This method has been described for example in U.S. Pat. No. 5,152,917. To manufacture an abrasive disc with the above method, the disc must be cut out of the material strip. This however, requires accurate die-cutting tools. Since the material strip also has an abrasive agent coating, the blades of the die-cutting tool are also subjected to significant wearing, due to which they have to be changed often. This is expensive both because of interrupted production and because of acquisition and installation of the new blades.

Manufacturing abrasive discs is further burdened by a large amount of waste generated in die cutting. This waste partly constitutes an unused raw material, and partly it has to be removed from the production line and destroyed or stored. Both of these factors naturally affect the costs of the abrasive disc in a negative manner.

In producing abrasive material out of an extensive material strip, it is also next to impossible to utilize production methods that would be technically advantageous. Such a method is, for example, the use of vacuum treatment of the surface layer of the abrasive disc. The costs of creating a vacuum over a material strip of a known type are far too high for this technique to be used.

It is also known from the prior art to coat an individual abrasive disc with a slurry of binding agent and sand according to, for example, U.S. Pat. No. 2,292,261. Here, a method is described according to which a disc is coated with a layer of abrasive agent slurry having correct viscosity. This layer is subjected to embossing with a structured plate before curing. The embossing creates a desired pattern in the abrasive agent slurry, which is subsequently cured. Since the desired pattern is, in this method, pressed in only momentarily, the result is not an exact replica but the pattern tends to spread to some extent, for instance, before the curing.

DEFINITION OF THE PROBLEM

With the present invention, the problems of known solutions can be substantially avoided. The invention thus provides a method for manufacturing a flexible abrasive disc as well as a flexible abrasive disc manufactured with this method, resulting in reliable manufacture and an abrasive disc with uniform properties.

The problems mentioned are solved in accordance with the invention by the manufacturing method and the flexible abrasive disc.

In the following description, the terms "upper", "lower", "upper side", "lower side" etc. refer to directions in relation to the abrasive disc or its structural details as shown in the attached figures.

With the method described in the present invention, several significant advantages over the prior art are obtained. Therefore, manufacturing abrasive discs piece by piece enables production of inexpensive molds because the abrasive disc has small dimensions. The manufacturing technique allows the use of disposable molds that have been cast against a positive original. Such disposable molds facilitate considerably the handling of the abrasive disc after it has been finished. In addition, it is simpler and thus also cheaper to manufacture a positive original mold and to cast the required negative molds from that, as opposed to manufacturing immediately the negative originals that would usually be required in the manufacture of abrasive discs according to conventional technology.

Since one single original mold can be used for producing a plurality of above-mentioned disposable molds, it is also economically possible to make the mold very complicated. This allows the surface structure of the abrasive disc to be affected more than what is usual.

In the manufacture of an abrasive disc according to the present invention, the abrasive disc is advantageously pressed in a press with upper and lower embossing pistons positioned opposite each other. Hereby, one embossing piston is advantageously provided with an embossing mold. By using inexpensive disposable molds that can remain with the final product in the curing process, the pressing together needs to take place only momentarily in the present method. The abrasive agent coating applied to the backing of the abrasive disc will keep the backing and the embossing mold together after the initial pressing.

Since each abrasive disc is handled in a separate press chamber formed between the upper and lower embossing pistons and having a small volume, it is simple to utilize a vacuum casting technique known as such. This technique allows particularly accurate castings to be made and improves thus the operating characteristics of the abrasive disc significantly.

Protecting the abrasive agent coating of the abrasive disc with a disposable mold makes it realistic to use not only UV curing but also for instance electron beam curing. Electron beam curing is, for example, economically feasible because it needs only a small radiation source for beam curing.

An abrasive disc which has been manufactured according to the present method and has also obtained the spherical cross-section according to the invention has better clogging properties in the use. The spherical shape reduces what is called "caking", i.e. dust build-up between the surface of the abrasive disc and the surface to be abraded.

Further, thanks to the spherical shape, the abrasive disc has a longer service life because the whole abrasive surface of the abrasive disc can be used, and not only the peripheral areas of the disc used for the most part normally. This is because the disc does not adhere to planar surfaces but air gets under the somewhat bent product. Hereby, the amount of the out-sucking air current increases, resulting in better dust removal. Positive results can be achieved even with abrasive discs having a large bending radius. The bending of the cross-section of the abrasive disc may be, for example, only a couple of millimeters in a 150-mm abrasive disc in order for the increased dust removal effect to be noticed.

Abrasion work carried out with the present abrasive disc is also facilitated because the spherical abrasive disc does not adhere in the same way as conventional planar abrasive discs or draw in different directions. Further, there is no need to hold the machine as hard as before or direct it at the object but it is possible to simply abrade with even the mid-area of the abrasive disc, for which only the hand's and arm's own weight is needed.

A spherical abrasive disc also makes it possible to reduce the abrasion area and to obtain discrete transition between the abraded and unabraded surfaces. This effect can be further intensified by providing the fastening surface in the fastening plate of the abrasive machine with a substantially spherical shape. In this way, a small inclination of the abrasive machine will not change the mutual geometry of the contact surfaces positioned opposite each other. Thus, with an abrasive machine with spherical oscillation it is possible, to an essential extent, to avoid an oblique position of the abrasive product arranged on the fastening surface of the machine. Hence, the abrasive machine does not require as exact positioning in the abrasion area as in known solutions and will be remarkably simpler to work with.

With the spherical abrasive surface, it will be possible to apply a more distinctive and higher abrasion pressure in the middle of the contact surface of the abrasive disc. Thus, the shaping allows more exact abrasion or polishing of only the particular defect present in the current abrasion area. Thanks to the present invention, the abrasion area is thus reduced and the edge area in the periphery of the abrasion area is less visible.

Further advantages and details of the invention become apparent from the description below.

BRIEF DESCRIPTION OF THE FIGURES

In the following, the invention will be explained in more detail with reference to the drawing, where.

PREFERRED EMBODIMENTS

Figure 1:
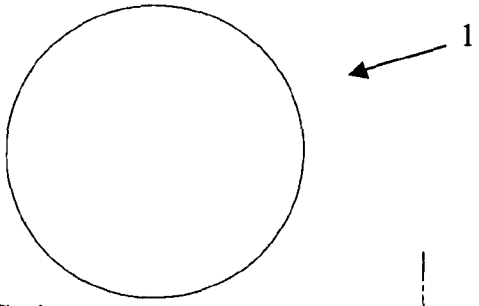
FIG. 1 shows a top view of an abrasive disc.
Figure 2:
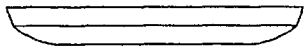
FIG. 2 shows a side view of an abrasive disc.
Figure 3:
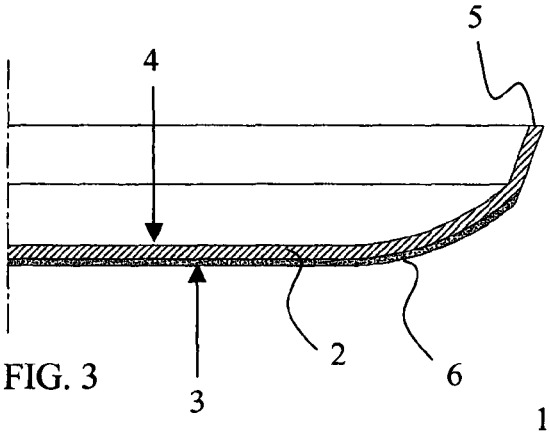
FIG. 3 shows a partial cross-section of an abrasive disc according to FIG. 2.
Figure 4:
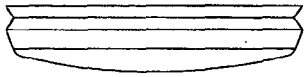
FIG. 4 shows an alternative embodiment of the abrasive disc seen from one side.
Figure 5:
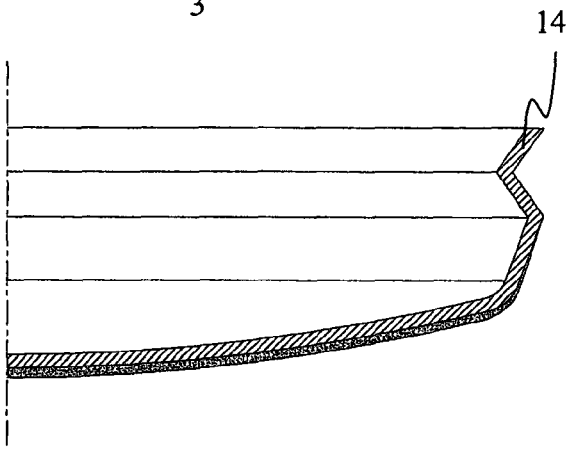
FIG. 5 shows a partial cross-section of an abrasive disc according to FIG. 4.
Figure 6:
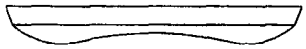
FIG. 6 shows a cross-section of a second alternative embodiment of the abrasive disc seen from one side.

Preferred embodiments of the method for manufacturing a flexible abrasive disc as well as such abrasive discs are described in the following with reference to the above-mentioned figures. The solutions thus comprise the structural parts shown in the figures, each of which is denoted with a corresponding reference numeral. These reference numerals correspond to the reference numerals given in the following description.

The present flexible abrasive disc 1 comprises according to FIGS. 1 to 6 a backing 2 with an upper side 3 and a lower side 4. The backing has in its periphery a side edge 5, which binds the upper side of the backing to its lower side. Further, the upper side of the backing is provided with an abrasive agent coating 6 for forming a surface layer and thus the final abrasive disc.

Figure 7:
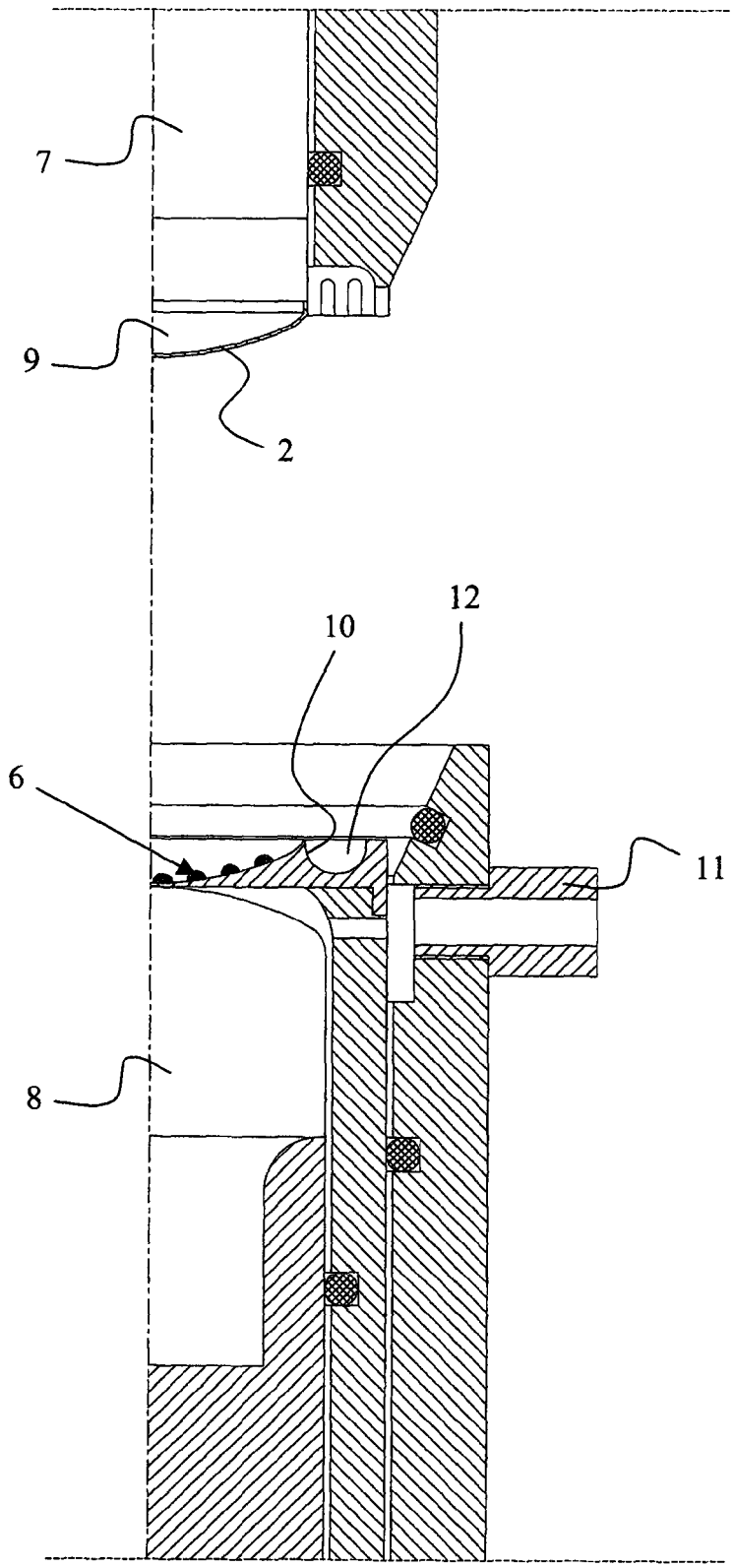
FIG. 7 shows a partial cross-section of a press for manufacturing the present abrasive disc, whereby the press is open for feeding.

In the manufacture of the present abrasive disc 1, the backing 2 is arranged separately on an embossing piston 7 according to FIG. 7, the backing of each abrasive disc being also coated separately. Each backing can thus be placed by itself in a press chamber formed of two embossing pistons 7 and 8 positioned opposite each other. It is, however, feasible to place the backing in one of several adjacent press chambers formed of two embossing pistons positioned substantially opposite each other. It is also feasible to place one or more backings adjacent to each other in one single press chamber without, however, any mutual contact, in which case they can also be coated separately.

Depending on the shaping of the backing 2, the embossing piston 7, which is in this embodiment referred to as the upper embossing piston, is provided with a replaceable press head 9 for supporting the backing against the surface of the embossing piston. If the lower surface 4 of the backing is for instance concave, the embossing piston is thus provided with a convex press head. Naturally, it is also feasible to provide a planar embossing piston with a lower mold of a suitable polymer material to support the backing against the surface of the embossing piston.

The backing 2 having been properly arranged on the upper embossing piston 7, an abrasive agent coating 6 is applied to the upper side of the backing. Hereby, the structure of the surface layer of the abrasive agent coating is formed advantageously by bringing an embossing mold 10, which is arranged on the lower embossing piston 8 opposite the backing, against the abrasive agent coating. The surface layer of the abrasive disc is thus embossed with a desired pattern by pressing together the embossing pistons positioned opposite each other.

The abrasive agent coating 6 can thus be applied directly to the upper side 3 of the backing 2, or alternatively it can be applied to the embossing mold 10 to be transferred to the backing in the pressing together of the pistons described above and illustrated in FIGS. 7 and 8.

By carrying out the work with a press having a press chamber with a small volume, it is simple to utilize a vacuum casting technique known as such. A vacuum pump (not shown) is connected to the press via a mouthpiece 11, after which the atmospheric pressure in the press chamber can be significantly decreased. Thanks to this press and embossing technique, the embossing mold can be provided with a particularly fine-grained structure that can be filled during the embossing, and no empty pockets are generated in the pattern.

The embossing mold 10 can be shaped advantageously according to FIGS. 7 to 10 with a surrounding collecting pocket 12 in its periphery. When the pistons are pressed together, part of the abrasive agent coating usually flows out. By allowing the collecting pocket to surround the embossing mold, this surplus material 13 can be recovered according to FIG. 10, and the press and its peripheral equipment are prevented from getting dirty.

After the pressing together has been completed, the abrasive agent coating 6 is cured, after which the molds that at least partly surround the finished abrasive disc 1 can be removed.

Applying the abrasive agent coating 6 can take place stepwise with alternating application of at least glue and sand to the upper side of the backing. Alternatively, the abrasive agent coating can be dripped, sprayed, injection-molded or injected to the upper side 3 of the backing 2, whereby for instance a slurry containing at least abrasive agent and binding agent is used. A screen print coating of the slurry is also possible, whereby the upper surface obtains small dots, i.e. glue spots, of the abrasive agent coating.

The outer layer is shaped substantially spherical by coating a spherical upper surface 3 on the backing 2. In this context, it can be noted that the spherical shape can naturally manifest itself as both convex and concave surfaces. If a concave spherical surface is used, it is the inside of the hollowed concave surface that is coated.

In the manufacture the spherical shape of the abrasive disc 1 can be, broadly speaking, adapted to the rounding of any particular surface, irrespective of whether it is a concave or a convex surface. Further, extra bending up 14 of the edge of the abrasive disc can be implemented to obtain discrete positioning.

Distribution of the abrasive agent coating 6, forming the structure of the surface layer, can be of different forms depending on the shaping of the embossing mold 10 brought to the lower embossing piston 8 to emboss the surface layer by the pistons being pressed together. The shaping of the surface structure of this embossing mold can be advantageously provided by manufacturing a special positive original embossing mold and subsequently casting it in simple polymer molds, for example. After this, an embossing mold thus shaped with a negative embossing mold of releasing polymer is brought to the lower embossing piston to carry out the embossing of the abrasive agent coating. Since such an embossing mold is simple and inexpensive to manufacture, it can advantageously be used only once. The releasing polymer may be an ordinary polyolefin, for example polypropylene or polyethylene, but can also be grafted with a polymer with even better releasing properties.

Since the original embossing mold does not come into contact with the abrasive agent coating 6, it is subjected to minimal wearing. The wearing, which is almost non-existent, and the small dimensions of the mold mean that its structure can be made very detailed. Hereby, what is called a micro replica mold is obtained. At the same time, this allows the pattern to be made non-linear and non-interferential. Thus, the composite formations of the abrasive agent coating are prevented from forming straight paths that can generate traces on the surface to be abraded if the abrasive disc has one-dimensional movement.

In a screen print coating, even distribution of the abrasive agent coating is obtained over the upper surface, meaning that before the pressing together of the pistons small dots are dosed over the surface, which then in the compression molding with the micro replica mold easily brings about the desired distribution.

Figure 8:
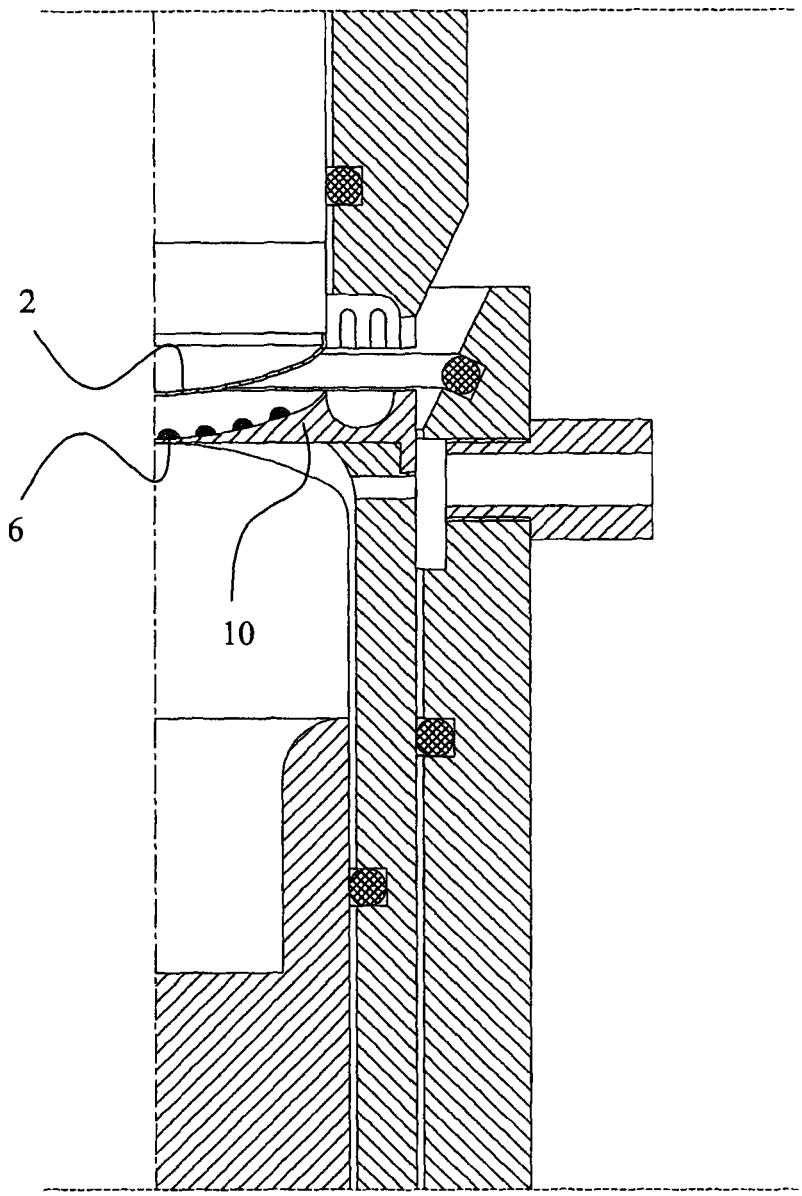
FIG. 8 shows a press, whereby the embossing pistons of the press are locked together.
Figure 9:
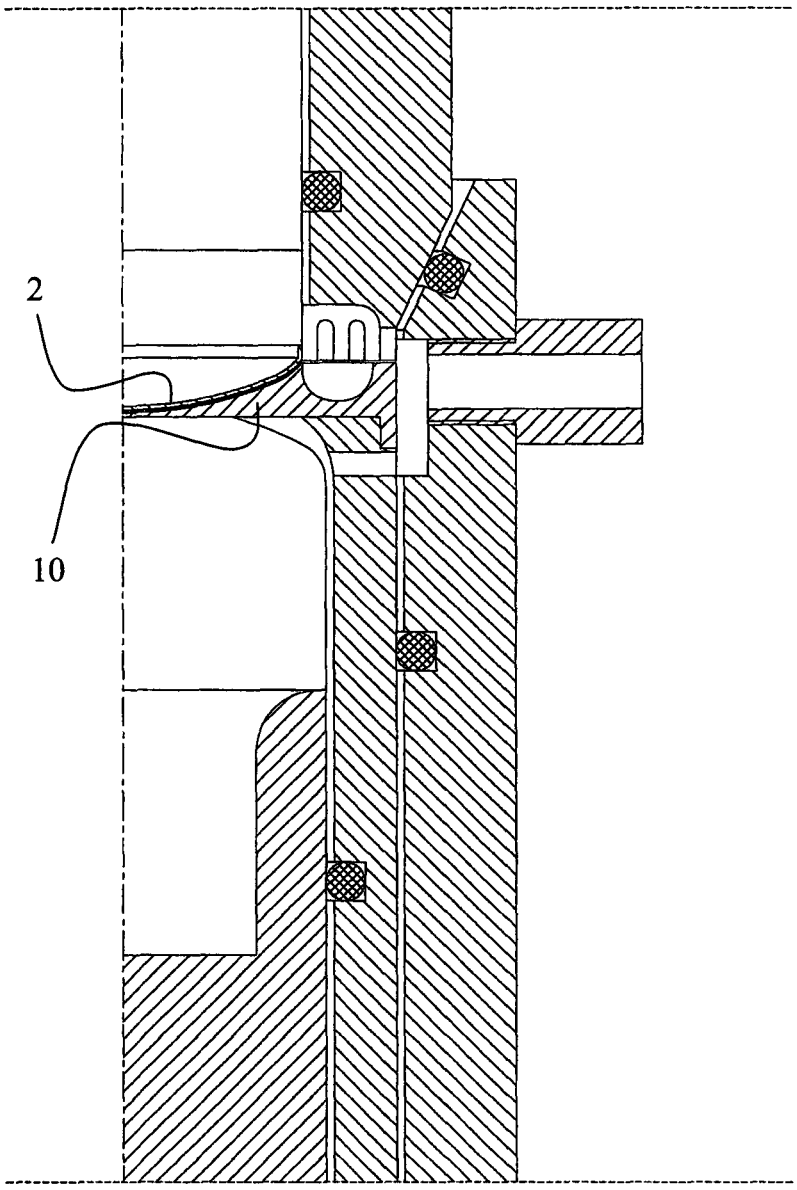
FIG. 9 shows a press, whereby the pressing together has been started.
Figure 10:
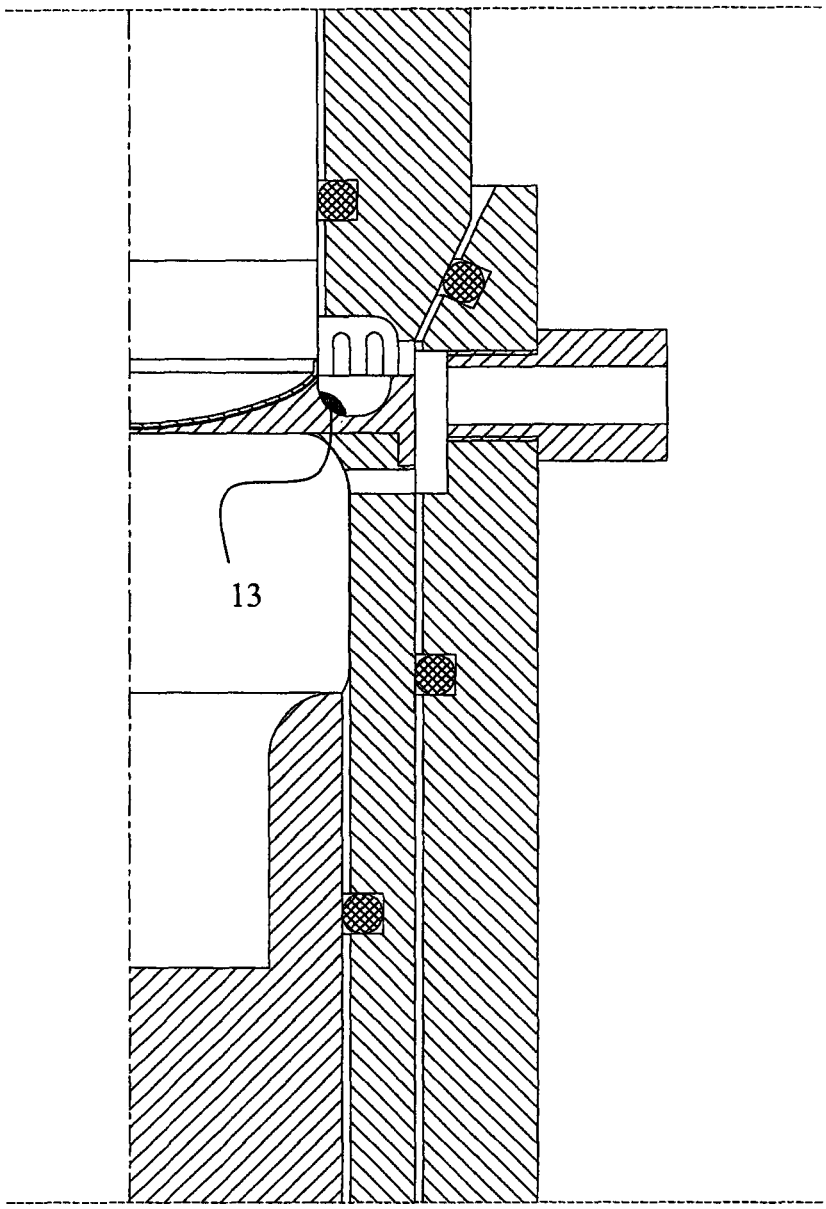
FIG. 10 shows a press, whereby the pressing together has been completed.

At the same time as the abrasive agent coating 6 is spread onto the backing 2, according to FIGS. 8 to 10, also the surface layer is structured. Hereby, the two embossing pistons 7 and 8 are brought together, in other words the upper embossing piston 7 with the backing 2 on it and the opposite lower embossing piston 8 with an embossing mold 10 arranged in it and having an embossing pattern. Thus, in the present method neither of the embossing pistons comes into direct contact with the abrasive agent coating, which is applied to the upper side 3 of the backing or the embossing mold, because the pistons are protected partly by the embossing mold and partly by the backing.

The lower embossing piston 8 having the embossing mold 10 with an embossing pattern can advantageously be formed of an elastic material and with a convex end surface. In this way, the embossing piston starts the pressing from the middle of the embossing mold according to FIG. 9. After this, the pressing pressure proceeds gradually like a ring wave out towards the periphery of the embossing mold as the embossing piston is being deformed at the increasing pressure according to FIG. 10. The surface of the upper embossing piston 7, or the press head 8 arranged in it, is rigid and corresponds advantageously to the backing.

The backing 2 and the embossing mold 10 arranged against the upper surface 3 are kept together, after the above-mentioned pressing together, by the surrounding atmospheric pressure and the abrasive agent coating 6 applied between them before the pressing. Therefore, it is simple to subject the abrasive agent coating to curing of some type known as such before the pressing.

By using a UV-cured resin as the binding agent of the abrasive agent coating and forming both the possible support mold of the backing and the embossing mold 10 of a transparent polymer letting UV rays pass, simple and advantageous curing of the abrasive disc 1 is obtained when it is transported through a cone of rays.

The present invention allows also electron beam cured resins to be used because the radiation source may be relatively small when only one abrasive disc 1 may be exposed to radiation at a time.

Above, the coating of the backing 2 of the abrasive disc 1 has been described. In this context, it can also be mentioned that the backing may be manufactured in compression molding in a separate mold, in which case its upper side 3 can be coated when the backing is still in the mold. The backing may also be manufactured in stretch molding to be subsequently arranged in a separate mold in which its upper side is then coated. The stretch-molded backing can be either cut off a stretch-molded material strip, or a planar backing material can be subjected to stretch molding when it is being cut off a material strip.

The backing 2 of the abrasive disc 1 has, in one of its embodiments, a structure with substantially even thickness, whereby its lower side 4 and the upper side 3 are substantially parallel and have substantially equal bending radii. The backing can, however, have a shape where the lower side and the upper side have different bending radii, whereby its lower side may be substantially planar, for example, while the upper side is spherically convex or concave. According to the present method, the upper side of the backing can be provided with a surface layer in the form of an abrasive agent coating 6 which is substantially of the shape of a spherical segment.

Deviating from today's paper-based abrasive discs, it is advantageous to manufacture the backing 2 of the present abrasive disc of a polymer material.

To simplify the use of the abrasive disc 1, the side edge 5 of the backing may be provided with fastening elements. These fastening elements are arranged to keep, like a lid, the finished abrasive disc fastened when the abrasive disc is, in use, arranged on a fastening plate of an abrasive head. The fastening elements may comprise an edge 14 drawn upwards according to FIG. 5, or hooks drawn upwards.

The abrasive disc 1 may also be provided with holes for extraction of dust or for supply of water. Further, it may also be provided with follower pins that cooperate with guide holes in the fastening plate. These follower pins make the fastening simpler and may, in some cases and particularly in combination with above-mentioned integrated fastening elements, eliminate conventional fastening elements, such as self-adhesive glue and Velcro fastening.

Naturally, the abrasive disc 1 may be provided with fastening elements known as such, such as self-adhesive glue and Velcro fastening on the lower side 4 of the backing 2, to fasten the abrasive disc to the fastening plate in the abrasive head of an abrasive tool.

The above description and the related figures are only intended to illustrate the present solution for the structure of an abrasive disc. Thus, the solution is not restricted to the embodiment described above or in the attached claims, but a plurality of variations and alternative embodiments are feasible within the idea described in the attached claims.

The invention claimed is:

1. A method for making a flexible abrasive disc with a pair of first and second opposed pistons and the use of an intermediary embossing mold for embossing an disc specific abrasive pattern on the disc, the abrasive disc comprising a backing with an upper side and a lower surface and a periphery; comprising the steps, in any order, of:

a) creating a plurality of individual separate flexible negative image intermediary molds from a positive original mold, said original mold having a pattern formed therein corresponding to a desired abrasive structure to be formed on the disc;

b) copying said pattern from said original mold to create a plurality of individual separate flexible intermediary molds by impressing said pattern from said original mold into said intermediary molds;

c) applying a backing material onto said first piston;

d) applying the mold onto said second piston;

e) inserting abrasive agent on the mold;

f) creating a vacuum in the space defined between the two pistons;

g) bringing said pistons toward each other, thereby bringing said intermediary mold and backing together;

h) forming a pattern on an upper surface of the backing whereby the abrasive agent is structured on said backing by said mold;

i) withdrawing at least one of said pistons to expose said mold;

j) curing the abrasive agent coating while the intermediary mold is still in contact therewith;

k) removing the intermediate mold;

l) replacing the mold after a plurality of uses with an identical mold made from said positive original.

2. A method according to claim 1, wherein the mold is formed of substantially transparent material so that curing by radiation case pass through the mold.

3. A method according to claim 1, wherein the abrasive agent is cured by electron beam radiation.

4. A method according to claim 1, including forming the mold of a generally transparent polymeric material.

5. A method according to claim 1, including forming a circumferential ridge and recess at the peripheral edge of said intermediary mold, so that the mold includes a debris catching recess.

6. A method according to claim 1, including forming at least one of said molds to include a spherical shape.

7. A method according to claim 1, whereby a separate piston surrounding the press piston forms a press chamber over the backing to be coated and where said press chamber can be evacuated to form a vacuum when forming the coating.

8. A method according to claim 1, whereby the backing and the intermediate mold are shaped to have a substantially spherical upper side.

9. A method according to claim 1, whereby the abrasive agent coating is applied stepwise with alternating application of at least binding agent and abrasive agent onto the upper side of the backing to form the surface layer.

10. A method according to claim 1, whereby the abrasive agent coating is applied to the upper side of the backing in the form of a slurry which comprises at least abrasive agent and binding agent to form the surface layer.

11. A method according to claim 1, whereby the backing and the embossing mold brought against the surface layer are kept together after the pressing together by the abrasive agent coating applied to the upper surface in the pressing together, and the abrasive agent coating is cured after the backing with the abrasive agent coating applied to the upper side has been removed from a press chamber formed by the press pistons.

12. The method of claim 1, wherein said periphery is drawn upwards to form a lid like edge on the disc, said lid including at least one intersection between surfaces that has a diameter smaller than the largest diameter of the disc, thereby creating a fastening surface of the disc to a disc support on a driving machine.

13. A method for making a flexible abrasive disc with a pair of first and second opposed pistons and the use of an intermediary embossing mold for embossing an disc specific abrasive pattern on the disc, the abrasive disc comprising a backing with an upper side and a lower surface and a periphery; comprising the steps, in any order, of:

a) creating a plurality of individual separate flexible negative image intermediary molds from a positive original mold, said original mold having a pattern formed therein corresponding to a desired abrasive structure to be formed on the disc;

b) copying said pattern from said original mold to create a plurality of individual separate flexible intermediary molds by impressing said pattern from said original mold into said intermediary molds;

c) applying a backing material onto said first piston;

d) applying the mold onto said second piston;

e) inserting abrasive agent on the backing material;

f) creating a vacuum in the space defined between the two pistons;

g) bringing said pistons toward each other, thereby bringing said intermediary mold and backing together;

h) forming a pattern on an upper surface of the backing whereby the abrasive agent is structured on said backing by said mold;

i) removing the intermediary mold.

14. A method according to claim 13 wherein one of the pistons is deformed when engaging the other piston, so that the abrasive agent is gradually spreading outward to create a ring wave in the coating spreading it toward the outer periphery of the disc.

15. A method according to claim 13, wherein one of the pistons is deformed when engaging the other piston, so that the abrasive agent is gradually spreading outward to create a ring wave in the coating spreading it toward the outer periphery of the disc.

16. A method for making a flexible abrasive disc with a pair of first and second opposed pistons and the use of an intermediary embossing mold for embossing an disc specific abrasive pattern on the disc, the abrasive disc comprising a backing with an upper side and a lower surface and a periphery; comprising the steps, in any order, of:

a) creating a plurality of individual separate flexible negative image intermediary molds from a positive original mold, said original mold having a pattern formed therein corresponding to a desired abrasive structure to be formed on the disc;

b) copying said pattern from said original mold to create a plurality of individual separate flexible intermediary molds by impressing said pattern from said original mold into said intermediary molds;

c) applying a backing material onto said first piston;

d) applying the mold onto said second piston;

e) inserting abrasive agent on the mold;

f) creating a vacuum in the space defined between the two pistons;

g) bringing said pistons toward each other, thereby bringing said intermediary mold and backing together;

h) forming a pattern on an upper surface of the backing whereby the abrasive agent is structured on said backing by said mold;

i) separating the pistons from engagement with the mold;

j) curing the abrasive agent coating while the intermediary mold is still in contact therewith;

k) removing the intermediary mold.

* * * * *